US008282356B2

(12) United States Patent
Cairo

(10) Patent No.: US 8,282,356 B2
(45) Date of Patent: Oct. 9, 2012

(54) APPARATUS AND METHOD FOR REDUCING WEAR IN DISK LUGS

(75) Inventor: Ronald Ralph Cairo, Greer, SC (US)

(73) Assignee: General Electric Company, Schenectady, NY (US)

( * ) Notice: Subject to any disclaimer, the term of this patent is extended or adjusted under 35 U.S.C. 154(b) by 518 days.

(21) Appl. No.: 12/611,173

(22) Filed: Nov. 3, 2009

(65) Prior Publication Data

US 2011/0103960 A1 May 5, 2011

(51) Int. Cl.
*F01D 5/02* (2006.01)

(52) U.S. Cl. ..... 416/219 R; 416/220 R; 416/221; 416/224; 416/229 A; 416/248; 29/889.21

(58) Field of Classification Search ..... 416/219 R, 416/220 R, 221, 224, 229 A, 248; 29/889.21
See application file for complete search history.

(56) References Cited

U.S. PATENT DOCUMENTS 2,317,338 A * 4/1943 Rydmark ..... 416/221
3,640,640 A * 2/1972 Palfreyman et al. ..... 416/2
3,784,320 A * 1/1974 Rossmann et al. ..... 416/215
3,841,794 A * 10/1974 Bergmann ..... 416/221
4,169,694 A * 10/1979 Sanday ..... 416/219 R
5,160,243 A * 11/1992 Herzner et al. ..... 416/220 R
5,368,444 A * 11/1994 Anderson ..... 416/220 R
6,267,558 B1 7/2001 Dingwell et al.
6,290,466 B1 * 9/2001 Ravenhall et al. ..... 416/229 A
2007/0189901 A1 8/2007 Dundas et al.

* cited by examiner

*Primary Examiner* — Igor Kershteyn

(74) *Attorney, Agent, or Firm* — Dority & Manning, P.A.

(57) ABSTRACT

A disk includes a disk lug and a wear element. The disk lug includes an outer surface, an inner surface radially inward of the outer surface, and a plurality of lateral surfaces between the outer surface and the inner surface, wherein the outer surface is wider than the inner surface. The wear element is disposed on at least one of the plurality of lateral surfaces, and the wear element creates a raised surface on at least one of the plurality of lateral surfaces. A method for installing a wear element to a disk lug includes machining a slot into the disk lug and inserting the wear element at least partially into the slot so that the wear element creates a raised surface on the disk lug.

17 Claims, 4 Drawing Sheets

APPARATUS AND METHOD FOR REDUCING WEAR IN DISK LUGS

FIELD OF THE INVENTION

The present invention generally involves gas turbines. Specifically, the present invention provides a system and method for reducing fretting wear in disk lugs in gas turbines.

BACKGROUND OF THE INVENTION

Gas turbines are widely used for power generation in commercial operations and propulsion in aviation and marine applications. A typical gas turbine includes a compressor at the front, one or more combustors around the middle, and a turbine at the rear. The compressor and the turbine typically share a common rotor, and each includes multiple stages of airfoils or "blades" attached to the rotor. Rotation of the airfoils in the compressor draws in a working fluid, increases the pressure of the working fluid, and discharges the compressed working fluid to the combustors. The combustors inject fuel into the flow of compressed working fluid and ignite the mixture to produce combustion gases having a high temperature, pressure, and velocity. Expansion of the combustion gases in the turbine causes the airfoils in the turbine to rotate to produce work.

A typical rotor system includes a disk, airfoils attached to the disk, and a shaft to connect the airfoil/disk stages. The outer perimeter of the disk is commonly referred to as a disk rim, and the disk rim includes circumferentially spaced disk lugs or posts. An airfoil attachment at the base of each airfoil fits between adjacent disk lugs to hold the airfoil in place. The airfoil attachment may include a dovetail or other complimentary shape to fit in the space between adjacent disk lugs. In this manner, complimentary surfaces between the disk lugs and the airfoil attachment hold the airfoil in place and prevent circumferential or radial movement of the airfoil during operation. Various techniques are used to provide axial restraint of the airfoil attachment. Industrial gas turbines, for example, utilize "staking" or locally deforming the base of the airfoil attachment. In addition, this mechanism facilitates easy removal and replacement of defective or worn airfoils as the need arises.

During operations, the disk typically rotates at speeds exceeding 3,000 rpm. A typical clearance between the disk lugs and the airfoil attachments is on the order of 0.001 to 0.002 inches to facilitate insertion of the airfoil attachments. In service, the airfoil attachments may move from 0.000 to 0.002 inches with respect to the disk lugs in a cyclic manner due to airfoil vibrations. This small relative motion can result in fretting wear between the airfoil attachments and the disk lugs. After extended periods of operation, the fretting wear may create cracks at the edge of contact locations on the airfoil attachments and/or disk lugs, potentially leading to premature failure and release of the airfoils.

A hard coating may be applied to the surfaces of the airfoil attachments to prevent or reduce the amount of fretting wear on the airfoil attachments. Various methods exist to apply the hard coating to the airfoil attachments before they are installed between the disk lugs on the disk. For example, the hard surface may be applied to the surfaces of the airfoil attachments using a plasma spray gun. This application method and others are relatively easy to accomplish before the airfoils attachments are installed between the disk lugs because of the readily available access and line of sight to the airfoil attachments before installation as required by typical coating deposition processes. However, the surfaces of the disk lugs are not readily accessible, and the space between adjacent disk lugs is typically not sufficient to allow the use of a plasma spray gun or similar applicator to apply the hard coating to the surfaces of the disk lugs.

Therefore, the need exists for an improved system and method for installing a hardened coating on the surfaces of disk lugs. Ideally, the improved system and method may allow for the installation of hardened coatings on the surfaces of the disk lugs, and the hardened coatings may be readily replaced after regular periods operations or whenever the need arises.

BRIEF DESCRIPTION OF THE INVENTION

Aspects and advantages of the invention are set forth below in the following description, or may be obvious from the description, or may be learned through practice of the invention.

One embodiment of the present invention is a disk that includes a disk lug and at least one wear element. The disk lug includes an outer surface, an inner surface radially inward of the outer surface, and a plurality of lateral surfaces between the outer surface and the inner surface, wherein the outer surface is wider than the inner surface. The at least one wear element is disposed on at least one of the plurality of lateral surfaces, and the at least one wear element creates a raised surface on at least one of the plurality of lateral surfaces.

Another embodiment of the present invention is a method for installing a wear element to a disk lug. The method includes machining a slot into the disk lug and inserting the wear element at least partially into the slot so that the wear element creates a raised surface on the disk lug.

A further embodiment of the present invention is a method for installing a wear element to a disk lug. The method includes applying the wear element to a side of a disk lug so that the wear element creates a raised surface on the disk lug. The method further includes attaching the disk lug to a disk rim.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
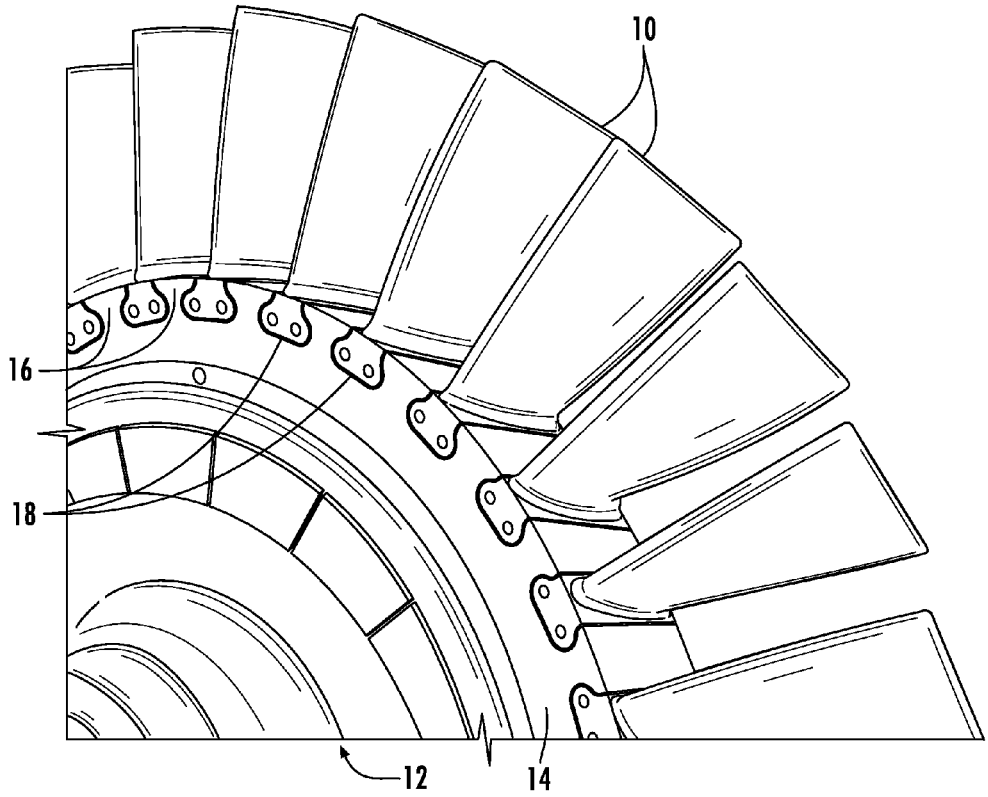
FIG. 1 shows a perspective view of a single stage of airfoils attached to a disk in a rotor system.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 shows a perspective view of a single stage of airfoils 10 attached to a rotor system. The rotor system is comprised of the airfoils 10, a disk 12 to which the airfoils 10 are attached, and a shaft (not shown) to connect the airfoil/disk stages. A disk rim 14 surrounds the outer perimeter of the disk 12, and the disk rim 14 includes circumferentially spaced disk lugs 16 or posts. An airfoil attachment 18 at the base of each airfoil 10 fits between adjacent disk lugs 16 to hold the airfoil 10 in place. The airfoil attachment 18 may include a dovetail or other complimentary shape to fit in the space between adjacent disk lugs 16. In this manner, complimentary surfaces between the disk lugs 16 and the airfoil attachment 18 hold the airfoil 10 in place and prevent circumferential or radial movement of the airfoil 10 during operation. Various techniques are used to provide axial restraint of the airfoil attachment 18. Industrial gas turbines, for example, utilize "staking" or locally deforming the base of the airfoil attachment 18. In addition, this mechanism facilitates easy removal and replacement of defective or worn airfoils 10 as the need arises.

Figure 2:
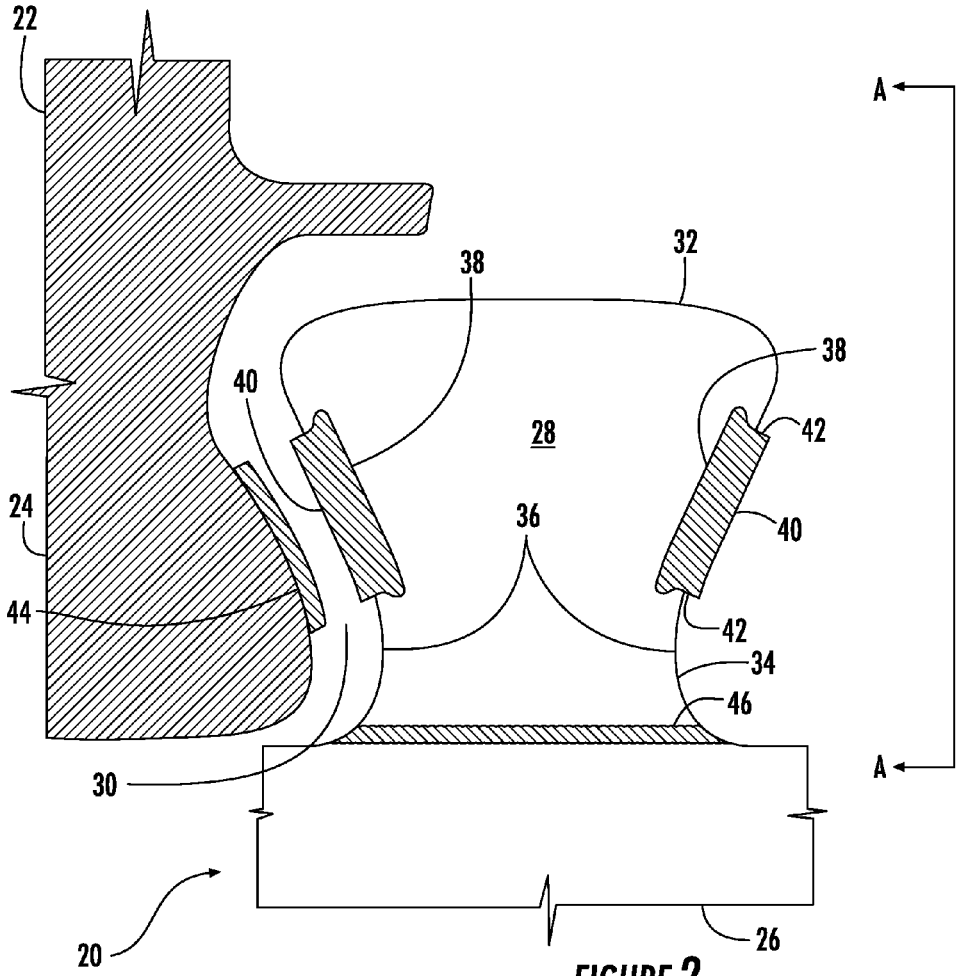
FIG. 2 shows a cross-section of one embodiment of a disk in a rotor system within the scope of the present invention.

FIG. 2 shows a cross-section of one embodiment of a portion of a disk 20 within the scope of the present invention. An airfoil 22 and airfoil attachment 24 are included in FIG. 2 to provide context for the disk 20. Although the airfoil attachment 24 is illustrated as a dovetail shape, any suitable shape for the airfoil attachment 24 may be used to securely hold the airfoil attachment 24 in place.

As shown in FIG. 2, the disk 20 includes a disk rim 26 and a disk lug 28. The disk rim 26 extends circumferentially around the disk 20, and a plurality of spaced apart disk lugs 28 or posts extend radially from the disk rim 26. Adjacent disk lugs 28 provide a cavity 30 for receiving the airfoil attachment 24. Each disk lug 28 generally includes an outer surface 32, an inner surface 34, and a pair of lateral surfaces 36. The outer surface 32 comprises the radially outward-most portion of the disk lug 28 (known as the disk's "dead" rim because it contributes to the inertia loading on the disk's rim), and the inner surface 34 is radially inward of the outer surface 32. The lateral surfaces 36 are between the outer surface 32 and the inner surface 34 and define a tapered cross-section of the disk lug 28 so that the outer surface 32 is generally wider than the inner surface 34. The spaced apart disk lugs 28 therefore provide a series of contoured cavities 30 around the perimeter of the disk 20 for receiving the airfoil attachments 24.

As shown in FIG. 2, the lateral surfaces 36 of the disk lug 28 define slots 38, and a wear element 40 is disposed at least partially in the slots 38. Ideally, the slots 38 are located in the lateral surfaces 36 to roughly correspond with the location of a hardened coating 44 or wear element on the airfoil attachment 24. Each slot 38 includes at least two sidewalls 42 on opposing sides of the slot 38 that define a width of the slot 38. As shown in FIG. 2, the width of the slot 38 increases inside the slot 38. This allows the wear element 40 to slide into the slot 38, and the sidewalls 42 of the slot 38 prevent the wear element 40 from moving radially inward or outward.

The wear element 40 may be made from virtually any material known in the art for reducing, preventing, or resisting fretting wear. For example, the wear element 40 may comprise a hardened material known as T800 which includes, by weight, 27-30% molybdenum, 16.5-18.5% chromium, 3-3.8% silicon, less than 1.5% iron, less than 1.5% nickel, less than 0.15% oxygen, less than 0.08% carbon, less than 0.03% phosphorus, less than 0.03% sulfur, and the balance of cobalt. Another suitable material for the wear element 40 may be a composition known as Stellite 6 which includes, by weight, 27-32% chromium, 4-6% tungsten, 0.9-1.4% carbon, 3% nickel, 3% iron, 1.6% silicon, and the balance of cobalt. Yet another suitable material for the wear element 40 may be a composition known as T400 which includes, by weight, less than 0.08% carbon, 7.5-9.5% chromium, 2.2-3% silicon, 27-30% molybdenum, less than 3% iron+nickel, less than 0.5% manganese, less than 0.02% boron, less than 0.025% sulfur, less than 0.025% phosphorus, less than 0.01% aluminum, less than 0.15% oxygen, less than 0.13% nitrogen, less than 0.5% other elements, and the balance of cobalt. Another suitable composition, referred to as CM64, includes, by weight, 26-30% chromium, 4-6% nickel, less than 0.5% molybdenum, 18-21% tungsten+molybdenum, 0.75-1.25% vanadium, 0.005-0.1% boron, 0.7-1% carbon, less than 3% iron, less than 1% manganese, less than 1% bismuth, and the balance of cobalt.

The wear element 40 may be of varying thicknesses, depending upon the depth of the slot 38. For example, the wear element 40 may be 60 to 80 mils thick so that the wear element 40 creates a raised surface on the lateral surfaces 36. The wear element 40 may be separately formed for subsequent installation on the disk lug 28. For example, the wear element 40 may be deposited as a continuous strip of material using various deposition techniques known in the art, such as air plasma spraying (APS), low pressure plasma spraying (LPPS), physical vapor deposition (PVD), wire arc thermal spraying, and high velocity oxygen fuel (HVOF) thermal spraying. The continuous strip may then be cut to fit the dimensions of the particular disk lugs 28 and inserted into the slots 38 in the disk lug 28.

The disk lug 28 and disk rim 26 may be a unitary or single piece construction. Alternatively, as shown in FIG. 2, the disk lug 28 may be manufactured separately, and a bond 46 between the disk lug 28 and the disk rim 26 may be used to attach the disk lug 28 to the disk rim 26. The bond 46 may be created using any metallurgical joining process known in the art, such as, for example, linear friction welding, diffusion bonding, transient liquid phase bonding, or variations of these known methods.

Figure 3:
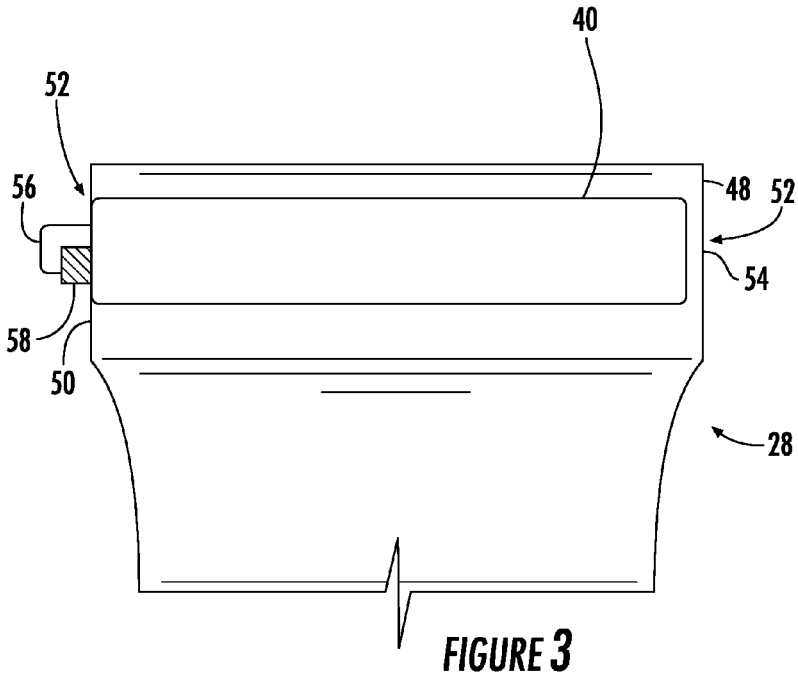
FIG. 3 shows a side view of the disk lug shown in FIG. 2 along line A-A.
Figure 4:
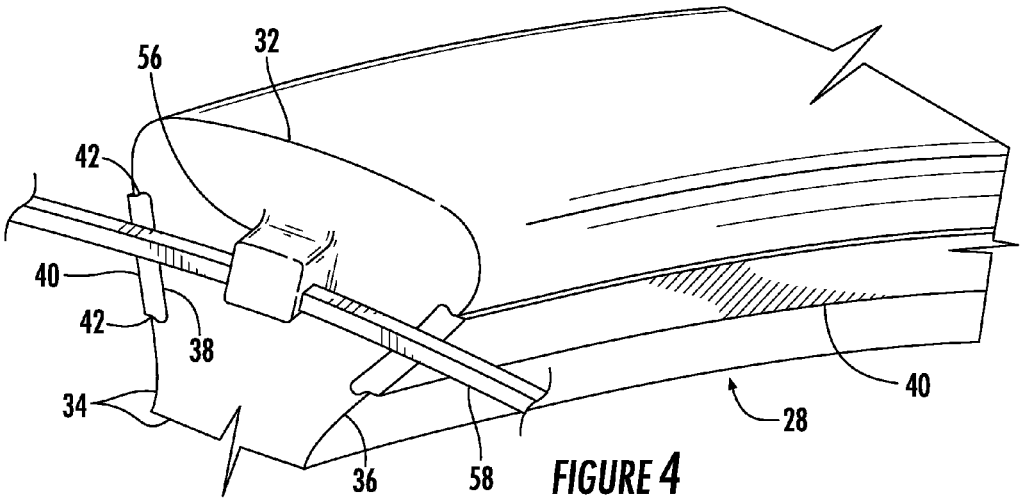
FIG. 4 shows a perspective view of the disk lug shown in FIG. 2.

FIG. 3 shows a side view of the disk lug 28 shown in FIG. 2 along line A-A, and FIG. 4 shows a perspective view of the disk lug 28 shown in FIG. 2. As shown in each view, the wear element 40 may be a continuous segment from near a front end 48 of the disk lug 28 to near a rear end 50 of the disk lug 28. In alternate embodiments, the wear element 40 may be a series of separate wear elements disposed between the front 48 and rear 50 end of the disk lug 28. As shown in FIG. 3, the disk lug 28 includes one or more retention elements 52 that hold the wear element 40 in place. For example, a bulkhead 54 or projection on the front end 48 of the disk lug 28 prevents axial movement of the wear element 40 past the bulkhead 54. Similarly, a tang 56 on the rear end 50 of the disk lug 28 may hold a snap ring 58 or bar across the rear end 50 of the disk lug 28. The snap ring 58 or bar may be installed after the wear element 40 has been inserted into the slot 38 to prevent the wear element 40 from moving axially rearward of the snap ring 58 or bar. It should be understood by one of ordinary skill in the art that various other suitable and equivalent structures are known in the art and available to serve as a retention element 52 to hold the wear element 40 in place. For example, lock wire, detents, brackets, braces, and adhesives may be suitable substitutes for the bulkhead 54 or snap ring 58 shown in FIG. 3.

The embodiment shown in FIGS. 2, 3, and 4 provides a method for installing the wear element 40 onto disk lugs 28 on new or existing disks 20. For example, the slot 38 may be machined into the new or existing disk lugs 28, and the sidewalls 42 may be machined into the slot 38 to prevent the wear element 40 from moving radially. In addition, retaining elements 52 may be added to the disk lug 28 to prevent the wear element 40 from moving axially. The wear element 40 may be separately fabricated, cut to fit the particular disk lug 28, and inserted at least partially into the slot 38 so that the wear element 40 creates a raised surface on the disk lug 28. The wear element 40 may be subsequently replaced with new wear elements at periodic intervals. Alternatively, at periodic intervals, the disk lug 28 may be removed from the disk rim 26 and replaced by a new disk lug having new wear elements.

Figure 5:
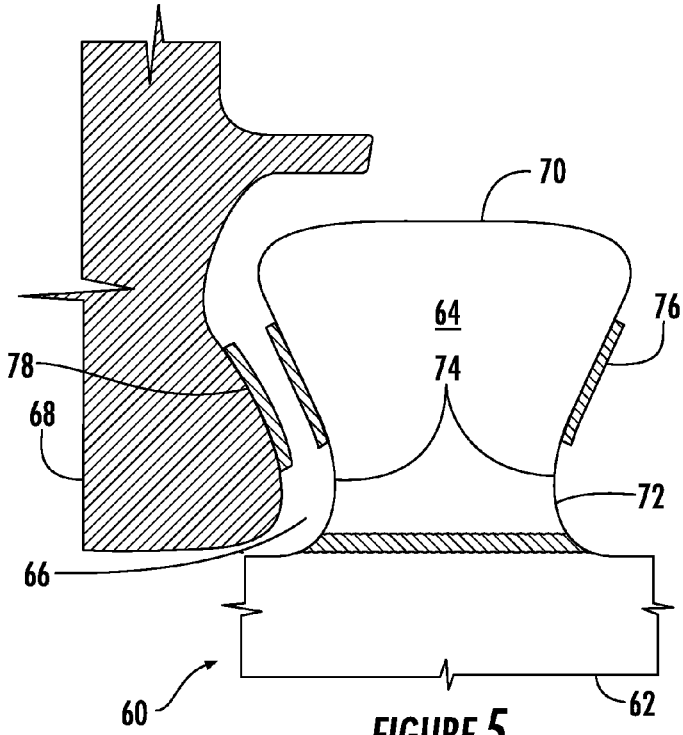
FIG. 5 shows a cross-section of an alternate embodiment of a disk in a rotor system within the scope of the present invention.
Figure 6:
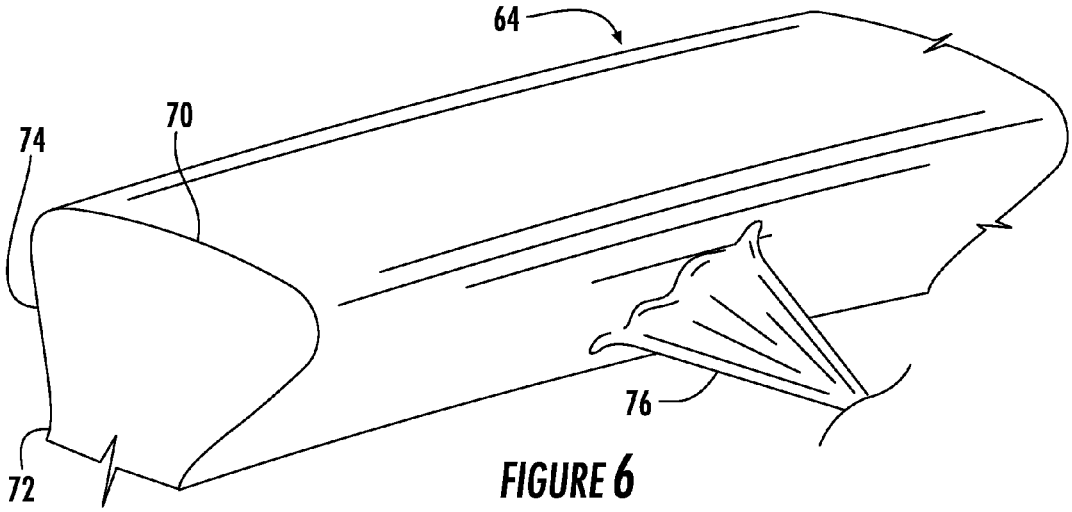
FIG. 6 shows a perspective view of the disk lug shown in FIG. 5.

FIGS. 5 and 6 illustrate an alternate embodiment of a disk 60 within the scope of the present invention. The disk 60 again includes a disk rim 62 and a disk lug 64. The disk rim 62 extends circumferentially around the disk 60, and a plurality of spaced apart disk lugs 64 extend radially from the disk rim 62. Adjacent disk lugs 64 provide a cavity 66 for receiving an airfoil attachment 68. Each disk lug 64 generally includes an outer surface 70, an inner surface 72, and a pair of lateral surfaces 74. The outer surface 70 comprises the radially outward-most portion of the disk lug 64, and the inner surface 72 is radially inward of the outer surface 70. The lateral surfaces 74 are between the outer surface 70 and the inner surface 72 and define a tapered cross-section of the disk lug 64 so that the outer surface 70 is generally wider than the inner surface 72. The spaced apart disk lugs 64 therefore provide a series of contoured cavities 66 around the perimeter of the disk 60 for receiving the airfoil attachments 68.

In the embodiment shown in FIGS. 5 and 6, a wear element 76 is applied directly onto the lateral surfaces 74 of the disk lug 64. The wear element 76 may be applied using any conventional means for applying material onto a metallic substrate. For example, the wear element 76 may be applied using air plasma spraying (APS), low pressure plasma spraying (LPPS), physical vapor deposition (PVD), and high velocity oxygen fuel (HVOF) thermal spraying. The applied wear element 76 creates a raised surface on the lateral surfaces 74 that corresponds with the location of a hardened coating 78 or wear element on the airfoil attachment 68. The disk lug 64 may then be attached to the disk rim 62 using any metallurgical joining process known in the art, such as, for example, linear friction welding, diffusion bonding, transient liquid phase bonding, or variations thereof.

The embodiment shown in FIGS. 5 and 6 provides a method for installing the wear element 76 onto disk lugs 64 for installation on new or existing disks 60. The wear element 76 may be applied directly to the disk lugs 64 using various deposition techniques previously described so that the wear element 76 creates a raised surface or coating on the disk lugs 64. The disk lugs 64 may then be attached to the disk rim 62 of the new or existing disk 60 using conventional metallurgical attachment techniques, as previously described. At periodic intervals, the disk lugs 64 may be removed from the disk rim 62 and replaced by new disk lugs having new wear elements.

It should be appreciated by those skilled in the art that modifications and variations can be made to the embodiments of the invention set forth herein without departing from the scope and spirit of the invention as set forth in the appended claims and their equivalents.

What is claimed is:

1. A disk, comprising:

a. a disk lug, wherein the disk lug includes
   i. an outer surface;
   ii. an inner surface radially inward of the outer surface;
   iii. a plurality of lateral surfaces between the outer surface and the inner surface, wherein the outer surface is wider than the inner surface and at least one of the plurality of lateral surfaces defines a slot having at least two sidewalls that define a width of the slot that increases at some point inside the slot; and b. at least one wear element disposed on at least one of the plurality of lateral surfaces and at least partially in the slot, wherein the at least one wear element creates a raised surface on at least one of the plurality of lateral surfaces.

2. The disk of claim 1, further including a retention element adjacent to the wear element, wherein the retention element prevents movement of the wear element past the retention element.

3. The disk of claim 2, wherein the retention element includes a bulkhead on at least one of the plurality of lateral surfaces.

4. The disk of claim 2, wherein the retention element includes a bar proximate to the wear element.

5. The disk of claim 1, wherein the disk lug further includes a front end and a rear end opposed to the front end, and wherein the wear element extends substantially continuously from near the front end to near the rear end.

6. The disk of claim 1, further including a plurality of wear elements disposed on each of the lateral surfaces, wherein the plurality of wear elements create a raised surface on each of the lateral surfaces.

7. The disk of claim 1, further including a disk rim surrounding the disk and a bond between the disk rim and the disk lug that connects the disk rim to the disk lug.

8. A method for installing a wear element to a disk lug, comprising:

a. machining a slot into the disk lug;

b. machining at least two sidewalls in the slot, wherein the at least two sidewalls define a width of the slot and the width of the slot increases at some point inside the slot; and c. inserting the wear element at least partially into the slot, wherein the wear element creates a raised surface on the disk lug.

9. The method of claim 8, further including forming a retention element on the disk lug, wherein the retention element prevents movement of the wear element past the retention element.

10. The method of claim 8, further including removing the wear element from the slot and inserting a second wear element at least partially into the slot, wherein the second wear element creates a raised surface on the disk lug.

11. The method of claim 8, further including attaching the disk lug to a disk rim.

12. The method of claim 11, further including attaching the disk lug to the disk rim by metallurgically joining the disk lug to the disk rim.

13. A method for installing a wear element to a disk lug, comprising:

a. applying the wear element to a side of a disk lug so that the wear element creates a raised surface on the disk lug; and b. attaching the disk lug to a disk rim.

14. The method of claim 13, further including applying the wear element to the side of the disk lug using a plasma spray gun.

15. The method of claim 13, further including attaching the disk lug to the disk rim by welding the disk lug to the disk rim.

16. The method of claim 13, further including applying a plurality of wear elements to at least two sides of the disk lug, wherein the plurality of wear elements create a raised surface on that at least two side of the disk lug.

17. The method of claim 13, further including applying a second wear element to a second disk lug so that the second wear element creates a raised surface on the second disk lug, removing the disk lug from the disk rim, and attaching the second disk lug to the disk rim.

* * * * *